US009459072B2

(12) United States Patent
Kafer

(10) Patent No.: US 9,459,072 B2
(45) Date of Patent: Oct. 4, 2016

(54) MAGAZINE ATTACHED FIREARM GRIP

(71) Applicant: Charles Kafer, Las Vegas, NV (US)

(72) Inventor: Charles Kafer, Las Vegas, NV (US)

( * ) Notice: Subject to any disclaimer, the term of this patent is extended or adjusted under 35 U.S.C. 154(b) by 0 days.

(21) Appl. No.: 14/477,751

(22) Filed: Sep. 4, 2014

(65) Prior Publication Data

US 2016/0069637 A1 Mar. 10, 2016

(51) Int. Cl.
*F41C 23/16* (2006.01)
*F41A 9/64* (2006.01)

(52) U.S. Cl.
CPC . *F41C 23/16* (2013.01); *F41A 9/64* (2013.01)

(58) Field of Classification Search
CPC ..... F41C 23/16; F41A 9/64; A45F 5/10; F45F 2005/1006; A45C 13/26; A45C 13/28
USPC ..... 42/72, 90, 104; 89/1.42; 294/145; 16/411, DIG. 12, DIG. 19; D22/108
See application file for complete search history.

(56) References Cited

U.S. PATENT DOCUMENTS 4,967,642 A * 11/1990 Mihaita ..... 89/126
D351,448 S * 10/1994 Fisher ..... F41C 23/16 42/71.02
5,465,520 A * 11/1995 Cupp ..... 42/71.02
5,584,136 A * 12/1996 Boland et al. ..... 42/7
5,621,997 A * 4/1997 Pearce ..... 42/71.02
6,073,381 A * 6/2000 Farrar et al. ..... 42/71.02
6,212,815 B1 * 4/2001 Fitzpatrick ..... 42/90
6,658,781 B1 * 12/2003 Bowen ..... F41C 23/16 42/71.02
7,191,557 B2 3/2007 Gablowski et al.
D604,794 S * 11/2009 Bentley ..... D22/109
7,676,975 B2 3/2010 Phillips et al.
7,823,312 B2 11/2010 Faifer
D633,164 S * 2/2011 Fitzpatrick ..... F41A 9/61 D22/108
D672,838 S * 12/2012 Mayberry et al. ..... D22/108
8,429,843 B2 4/2013 Yan
8,438,769 B1 5/2013 Ghannam
D689,581 S * 9/2013 Fitzpatrick et al. ..... D22/108
8,533,987 B2 9/2013 Rogers et al.
8,590,201 B2 11/2013 Brixius
2002/0170224 A1 * 11/2002 Lawless ..... 42/71.02
2004/0200111 A1 * 10/2004 Horn ..... 42/50
2004/0255504 A1 * 12/2004 Fitzpatrick ..... F41A 9/65 42/49.01
2005/0011097 A1 * 1/2005 Freed ..... F41A 9/65 42/49.02
2006/0242877 A1 * 11/2006 Clifton, Jr. ..... F41A 9/68 42/49.01

(Continued)

OTHER PUBLICATIONS

MagGrips, LLC, MagGrip Kit Installation & Removal, Oct. 2011, 3 pages.

*Primary Examiner* — Bret Hayes
(74) *Attorney, Agent, or Firm* — Lightbulb IP, LLC

(57) ABSTRACT

A magazine attached firearm grip provides an off hand grip for various firearms while allowing its user to present a small target to adversaries. A magazine attached firearm grip comprises recesses at a front side of its body and a groove at its rear side. The grove engages and is attached to an edge at a bottom end of a magazine. Once a top end of the magazine is inserted into a magazine well of a firearm the magazine attached firearm grip provides a gripping area for a firearm that receives a user's off hand. The tactile elements of the magazine attached firearm grip, such as the recesses and walls thereof allow for touch based installation and removal of the magazine without the need for visual inspection.

18 Claims, 4 Drawing Sheets

(56) References Cited

U.S. PATENT DOCUMENTS

2007/0157501 A1* 7/2007 Cammenga ..... F41A 9/67 42/87
2010/0263254 A1* 10/2010 Glock ..... 42/71.02
2011/0167698 A1* 7/2011 Hoguc ..... 42/71.02
2012/0167431 A1* 7/2012 Rogers ..... F41C 23/16 42/72
2012/0174452 A1* 7/2012 Anderson ..... F41A 9/65 42/49.01
2013/0061505 A1* 3/2013 Faifer ..... F41A 9/83 42/87
2014/0007480 A1* 1/2014 Pulit, Jr. ..... F41A 15/00 42/50
2015/0128467 A1* 5/2015 Fitzpatrick ..... F41C 23/16 42/2

* cited by examiner

MAGAZINE ATTACHED FIREARM GRIP

BACKGROUND OF THE INVENTION

1. Field of the Invention

The invention relates to firearms and in particular to a magazine attached firearm grip for various firearms.

2. Related Art

Various grips for firearms of various kinds have been developed over the years. In general, firearms include their own grips or gripping areas to allow for their safe and desired operation. Such grips may be positioned to receive a user's firing hand, off hand or both.

Firearm grips are also available as attachments that are attached directly to a firearm. Typically, these firearm grips are configured to receive a user's off hand. For instance, forward grips give a user a structure, attached to a firearm, at which the user can grip the firearm with his or her off hand. U.S. Pat. Nos. 7,191,557, 7,676,975, 8,429,843, 8,438,769 disclose forward grips that attach to a firearm to provide a grip for a user's off hand during firing. As their name implies, these forward grips are positioned at a forward or front portion of a firearm.

Firearm grips that extend at the magazine well of a firearm also exist. U.S. Pat. Nos. 7,823,312 and 8,590,201 disclose magazine well extensions that provide a grip for a user's off hand. These firearm grips extend outward near or at the magazine well and, due to this placement, can obstruct insertion and removal of magazines.

It is also possible for a user to grip a firearm at various other places. For example, it is possible for a user to grip a firearm with his or her off hand at a hand guard or other portion of the firearm. During use however, it is not advisable for a user to grip a firearm at some areas due to heat generated from firing ammunition. Moreover, even in areas of a firearm that do not heat up, such areas should not be used to hold or grip the firearm due to lack of grip. This is especially so in tactical or other stressful situations. It is not desirable for a user to grip a firearm at its barrel, magazine well, or magazine for these reasons.

From the discussion that follows, it will become apparent that the present invention addresses the deficiencies associated with the prior art while providing numerous additional advantages and benefits not contemplated or possible with prior art constructions.

SUMMARY OF THE INVENTION

A magazine attached firearm grip is disclosed herein. As will be described further herein, the magazine attached firearm grip provides a number of advantages. For instance, the magazine attached firearm grip provides a gripping area at the magazine of a firearm that, when in use, allows a user to present a small target to adversaries and to have a tight pivot point for increased control of the firearm. In addition, the magazine attached firearm grip includes elements or features that can be discerned by touch alone thereby allowing a user to insert and remove a without the need to first look at or visually inspect the magazine. Moreover, the magazine attached firearm grip may be integrally formed with a magazine or may be attached to a user's existing magazines.

Various embodiments of a magazine attached firearm grip are disclosed herein. For instance, in one exemplary embodiment, a firearm grip is disclosed with such firearm grip comprising a magazine comprising a compartment for holding ammunition and a top portion for insertion into a magazine well of a firearm, a grip body comprising two sides, a top end, a bottom end, a front side, and a rear side, and a groove formed in the rear side extending from the top end to the bottom end. An edge of the magazine is received with the groove and attached thereto. A plurality of recesses are at the front side of the grip body. Each of the plurality of curved recesses are defined by at least one wall and oriented to extend laterally between the two sides of the grip body. The grip body may be a single unitary structure or may comprise individual separate wall sections.

It is noted that the grip body may be formed from a flexible material. Also, an end may be formed at the top or bottom end of the grip body. Alternatively or in addition, a half recess may be formed at the top or bottom end of the grip body. The groove may be attached to the edge of the magazine by an adhesive, by one or more mechanical fasteners, or both.

In another exemplary embodiment, a magazine with a firearm grip is disclosed, with such magazine with a firearm grip comprising a compartment for holding ammunition, a top portion for insertion into a magazine well of a firearm, and a bottom portion.

The bottom portion comprises a grip body at an edge of bottom portion, with the grip body comprising two sides, a top end and a bottom end. A plurality of walls extending outward at a front side of the grip body, and one or more recesses are between each pair of the plurality of walls for receiving one or more fingers. The recesses extend laterally between the two sides of the grip body.

It is contemplated that a half recess may be at the top or bottom end of the grip body. Alternatively or in addition, an end at the top or bottom end of the grip body. A groove may be at a rear side of the grip body. In such case, the bottom portion is received with the groove to attach the grip body to the bottom portion. The grip body is formed from a flexible material and the compartment is not. A textured surface may be on at least the recesses. Alternatively, a textured coating may be on at least the recesses.

Various methods are also disclosed herein. For example, in one embodiment, a method for forming a magazine with a firearm grip is disclosed, with such method comprising providing a grip body comprising one or more recesses extending laterally between two sides of the grip body at a front side of the grip body, forming a groove at a rear side of the grip body, receiving an edge of a bottom end of a magazine in the groove with the bottom end of the magazine being capped while a top end of the magazine is open, and securing the grip body to the edge of the bottom end of the magazine. The recesses are formed between a plurality of outward extending walls.

It is contemplated that a half recess or an end may be formed at a top or bottom end of the grip body. The grip body may be bent or flexed to conform to the edge of the bottom end of the magazine, wherein the grip body is formed from a flexible material. An adhesive may be applied between the groove and the edge of the bottom end of the magazine to secure the grip body to the magazine. Alternatively or in addition, one or more mechanical fasteners that extend from the grip body may be engaged to one or more corresponding openings in the magazine to secure the grip body to the magazine.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The magazine attached firearm grip herein provides a grip for manipulating or operating a firearm. Typically, the magazine attached firearm grip will receive a user's off hand during use. In this manner, a user can not only hold a firearm but also permit a user to aim or operate his or her firearm with both hands. As will be disclosed further below, unlike traditional firearm grips (such as forward grips), the magazine attached firearm grip provides this benefit while preserving the user's ability to present a small target to adversaries, increasing safety. In addition, the magazine attached firearm grip enables users to maintain a tighter pivot point when manipulating or operating a firearm, which increases control over the firearm. Also, unlike traditional firearm grips that are positioned at or near a magazine well, the magazine attached firearm grip herein does not obstruct or interfere with insertion or removal of a magazine. This is highly advantageous, especially in tactical or other high stress situations.

Figure 1A:
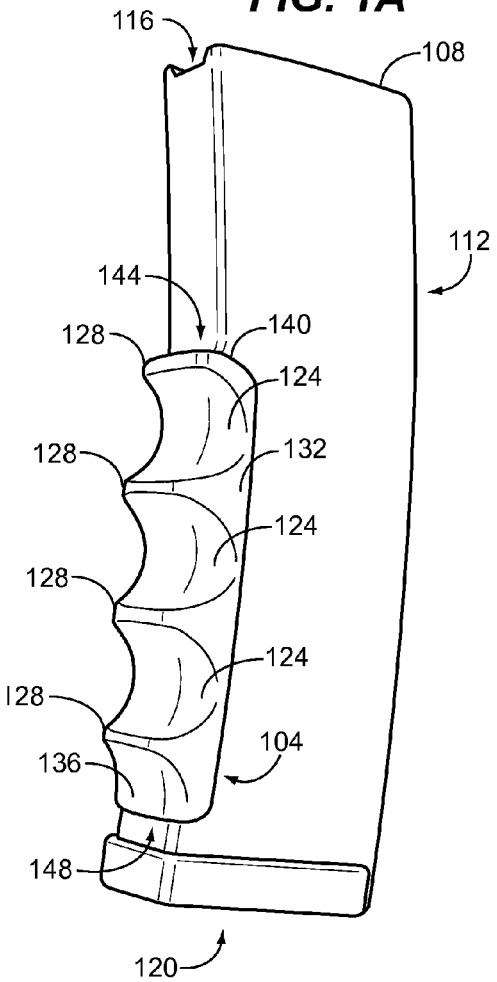
FIG. 1A is a perspective view of an exemplary magazine attached firearm grip and magazine.
Figure 1B:
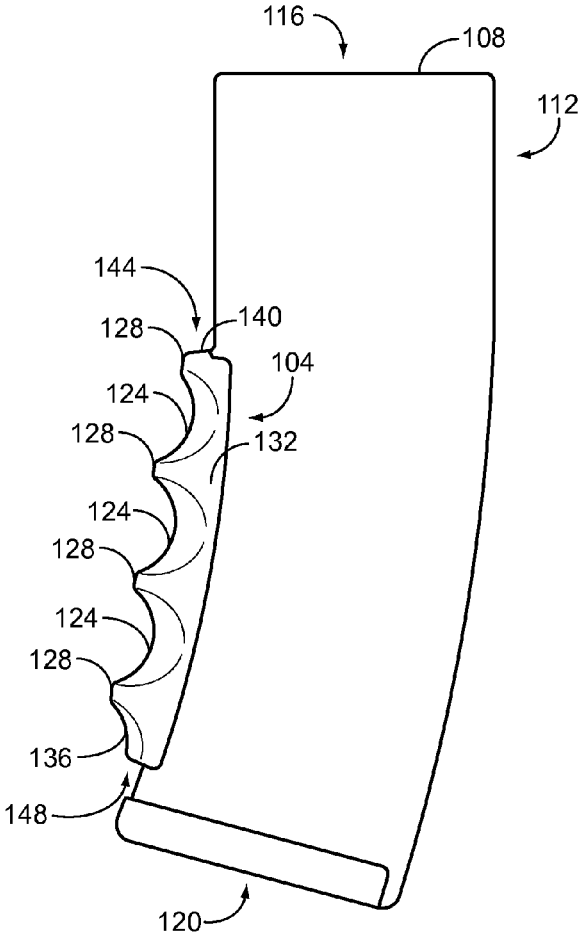
FIG. 1B is a side view of an exemplary magazine attached firearm grip and magazine.

FIGS. 1A-1B illustrate an exemplary magazine attached firearm grip 104 and its associated magazine 108. It is noted that a magazine attached firearm grip 104 may be integral with a magazine 108 or may be a separate structure attached thereto. In one or more embodiments, the magazine attached firearm grip 104 comprises a body 132 (hereinafter "grip body") in which one or more recesses 124 may be formed. Each recess may be defined by one or more walls 128.

As shown, each recess 124 has a concave shape. This provides a structure suited to accept a user's finger. Typically, each recess 124 will be sized to accept the width of one finger, with the space between a recess' walls 128 defining the maximum width of the recess. It is contemplated that a recess' walls 128 may be spaced further apart so as to receive multiple fingers in a single recess in some embodiments.

A recess 124 will typically have a concave curved shape, such as shown. Other shapes are contemplated herein as well. For example, a recess may have a squared concave "U" shape rather than the curved "U" shape illustrated in FIGS. 1A-1B. Alternatively, a recess 124 may have an angular concave shape, such as a partial hexagonal, octagonal or other partial polygonal shape.

The magazine attached firearm grip 104 shown includes three recesses 124 and a half recess 136 (though various numbers of each are contemplated). As can be seen, a half recess 136 can be distinguished from a "full" recess 124 on the basis that a half recess is defined by a single wall 128. A half recess 136 extends beyond its wall 128 and may still engage or receive a user's finger however.

A magazine attached firearm grip 104 may also include an end 140. As can be seen, an end 140 may be defined by a wall 128 at the top end 144 or bottom end 148 of a magazine attached firearm grip 104. FIGS. 1A-1B illustrate an end 140 at the top end of a magazine attached firearm grip 104 for instance. As opposed to a half recess 136, an end 140 does not extend past its defining wall 128. It is contemplated that a magazine attached firearm grip 104 may comprise an end 140 or half recess 136 at its top end 144, bottom end 148, or both.

In some embodiments, a magazine attached firearm grip 104 may comprise multiple separate portions. For example, a magazine attached firearm grip 104 may comprise individual walls 128 that extend outward from a magazine 108. This optional separation of walls 128 is shown by the dashed lines of FIG. 1C. It is noted that a wall 128 may expand outward at its proximal end, such as shown. Alternatively, a wall 128 may be the same size or substantially the same size at its distal and proximal ends.

As shown, the magazine attached firearm grip 104 is positioned at a front edge or side 152 of its associated magazine 108. It is contemplated that one or more magazine attached firearm grips 104 may be associated with a single magazine 108. For instance, another magazine attached firearm grip 104 may be at a rear edge or side 112 or other portion of a magazine 108. The magazine attached firearm grips 104, if more than one are provided, may have the same or different numbers of recesses 124 or half recesses 136.

Typically, a magazine attached firearm grip 104 will be positioned at a bottom end 120 of a magazine 108. This allows the top end 116 of the magazine 108 to be properly inserted into a magazine well of a firearm. As can be seen from FIGS. 1A-1C for example, the magazine attached firearm grip 104 is positioned away from the top end 116 of the magazine 108 so as to not obstruct insertion of the top end 116 of the magazine into a magazine well, while still providing multiple recesses 124 for receiving a user's grasp.

Various materials may be used to form a magazine attached firearm grip 104. For example, a magazine attached firearm grip 104 may be formed with plastic, rubber, wood, metal, composites or other natural or manmade materials. Typically, the material used will be rigid or semi-rigid. Alternatively or in addition, a magazine attached firearm grip 104 may be coated or covered with one or more coatings, such as to provide a textured surface to improve grip. Such coating may be applied at one or more recesses 124. It is contemplated that the magazine attached firearm grip 104 may alternatively be formed with an external textured surface to improve grip as well. In one or more embodiments, the textured surface will be at the one or more recesses 124 of a magazine attached firearm grip 104.

Figure 2:
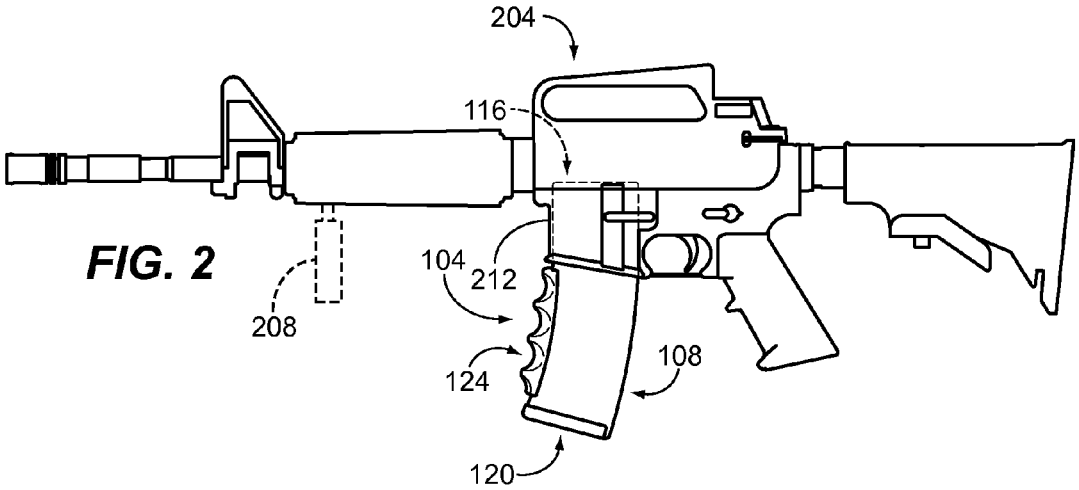
FIG. 2 is a side view of an exemplary magazine attached firearm grip installed in a firearm.

FIG. 2 illustrates a magazine attached firearm grip 104 in an exemplary environment of use. Namely, FIG. 2 illustrates a magazine attached firearm grip 104 installed in a magazine well 212 of a firearm 204. Typically, a magazine 108 will comprise a compartment 160 for holding ammunition (e.g., cartridges) therein. A top end 116 of the magazine 108 is open to allow ammunition to be inserted into and removed from the magazine. The top end 116 is inserted into a magazine well 212 to allow the magazine to deliver ammunitions to the firearm 204.

As can be seen, the magazine attached firearm grip 104 provides a gripping area that receives the off hand grip of a user at a bottom end 120 of a magazine 108. The user's firing hand can then grasp the trigger assembly of the firearm 204 to operate the firearm.

The walls 128 of each recess 124 of the magazine attached firearm grip define a position for a user's off hand that can be located by touch alone in that the user can quickly and easily feel where his or her off hand is relative to the magazine attached firearm grip 104 and the firearm 204 in which the magazine attached firearm grip is inserted. This is advantageous in that it allows the user to confirm their hand position without visual inspection and in that it helps ensure a consistent position for the user's off hand (without visual inspection) during operation of a firearm 204.

As described briefly above, another advantage of the magazine attached firearm grip 104 is that it allows a user to present a small target in tactical situations. This is because the magazine attached firearm grip 104 places its recesses 124 at a firearm's magazine 108. This placement allows a user to position his or her off hand further back when holding a firearm 204 thereby presenting a more compact target for adversaries and increasing the user's safety. The position of a typical forward grip 208 is illustrated in FIG. 2 in dashed lines for comparison purposes. As can be seen, gripping a firearm 204 at a forward grip 208 expands the user as a target by forcing the users off hand and arm to extend further outward.

The positioning of a users off hand created by the magazine attached firearm grip 104 also increases control over a firearm by providing a tighter pivot point since the user's off hand is not overly extended. This is advantageous in manipulating, aiming or otherwise operating a firearm. The recesses 124 provided by the magazine attached firearm grip 104 help ensure stability and control while the user grips the firearm at the magazine attached firearm grip.

Yet another advantage of the magazine attached firearm grip 104 is that, as stated above, the magazine attached firearm grip does not interfere with the insertion or removal of a magazine 108. Unlike magazine well-mounted firearm grips the magazine attached firearm grip 104 does not include any structures or elements that affix to or extend from a firearm's magazine well 212, which are known to obstruct or hinder insertion of magazines 108.

In fact, the magazine attached firearm grip 104 herein aids in the processes of inserting and removing a magazine 108. First, the magazine attached firearm grip 104 provides recesses 124 at a magazine 108 that increase a user's grip on the magazine. Second, the recesses 124 and walls 128 give the user a tactile sense of where his or her hand is relative to the magazine without need for visual inspection. In this manner, a user can insert a magazine 108 having a magazine attached firearm grip 104 based on his or her sense of touch alone. This is highly advantageous in inserting and removing a magazine 108, especially in a tactical or other stressful situation.

Figure 3A:
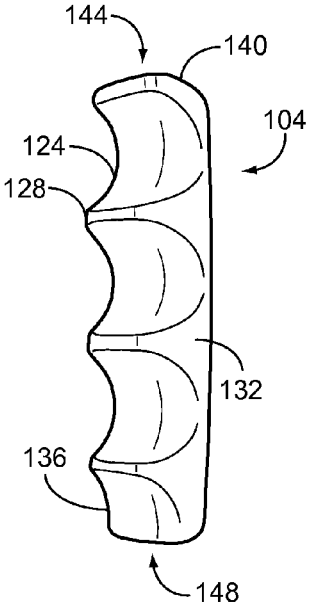
FIG. 3A is a front perspective view of an exemplary magazine attached firearm grip.
Figure 3B:
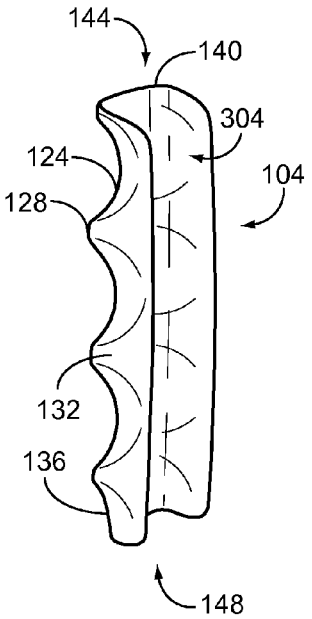
FIG. 3B is a rear perspective view of an exemplary magazine attached firearm grip.

FIGS. 3A-3B respectively illustrate a front and back perspective view of a magazine attached firearm grip 104 separate from a magazine. As stated above, a magazine attached firearm grip 104 may be provided as a separate element for attachment on a variety of magazines. A magazine attached firearm grip 104 can be used to retrofit an existing magazine in this manner. It is contemplated that a magazine attached firearm grip 104 may be attached to a magazine during manufacturing or later, such as by an end user.

Referring to FIG. 3B, it can be seen that a magazine attached firearm grip 104 may receive a portion of a magazine to attach thereto. More specifically, a magazine attached firearm grip 104 may comprise a groove 304 formed along the length of its grip body 132 that is sized and/or shaped to receive an end or other portion of a magazine. In one or more embodiments, a groove 304 may be a negative of the end or other portion of a magazine at which the magazine attached firearm grip 104 is to be attached. In other embodiments, a groove 304 may simply conform to the general shape of the portion of a magazine to which the magazine attached firearm grip 104 is to be attached. To illustrate, the groove 304 of FIG. 3B is slightly curved to conform to the front side of a correspondingly curved magazine.

In yet other embodiments, a groove 304 need not conform to any particular magazine's shape. It is contemplated that, in such embodiments, a magazine attached firearm grip 104 may be formed from flexible material to allow its groove 304 to accept and conform to a variety of magazines.

Figure 3C:
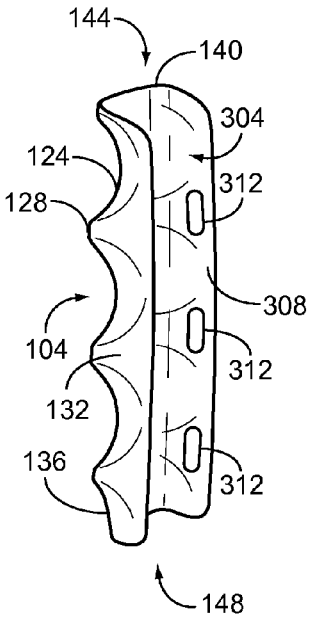
FIG. 3C is a rear perspective view of an exemplary magazine attached firearm grip having adhesive as a fastener.

A magazine attached firearm grip 104 may be attached to a magazine in various ways. For instance, in one embodiment, adhesive may bond or weld a magazine attached firearm grip 104 to a magazine. The adhesive will typically be applied to a surface 308 of the groove 304, its mating surface on the magazine, or both. In some embodiments, the adhesive may be borne on one or more adhesive strips applied to the groove 304. FIG. 3C illustrates an embodiment with exemplary adhesive/adhesive strips 312.

Alternatively or in addition, a magazine attached firearm grip 104 may be attached mechanically, such as via one or more fasteners, a friction fit, a snap fit or various other mating structures. In at least some of these embodiments, it is contemplated that the magazine attached firearm grip 104 may be removable such as to allow the magazine attached firearm grip to be removed and reattached or attached to another magazine as desired.

Figure 3D:
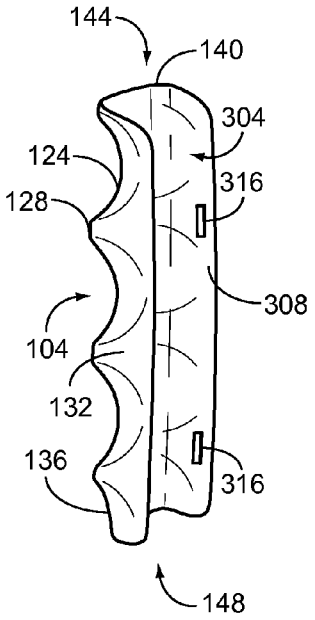
FIG. 3D is a rear perspective view of an exemplary magazine attached firearm grip having mechanical fasteners.
Figure 3E:
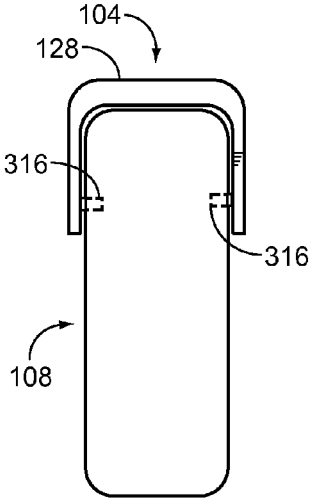
FIG. 3E is a top cross sectional view illustrating mechanical fastening of an exemplary magazine attached firearm grip.

As shown in FIG. 3D, a magazine attached firearm grip 104 may comprise one or more protruding members 316, such as pins, tabs, hooks or the like, that engage a corresponding receiving structure, such as a detent or opening, formed in a magazine. It is noted that the protruding members 316 may be formed on the magazine with the corresponding receiving structures being on the magazine attached firearm grip 104 in alternate embodiments. FIG. 3E illustrates a cross sectional view showing mechanical attachment of a magazine attached firearm grip 104 to a magazine 108. As can be seen, the receipt of a protruding member 316 by a corresponding receiving structure 320 secures the magazine attached firearm grip 104 to the magazine 108.

Figure 3F:
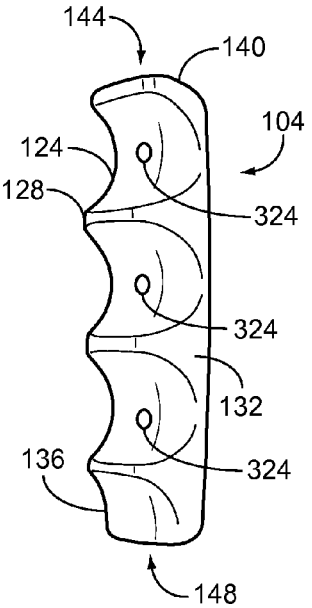
FIG. 3F is a front perspective view of an exemplary magazine attached firearm grip having openings for mechanical fasteners.

It is noted that a protruding member 316 may be a screw, pin or the like inserted into a threaded or other receiving structure or opening formed in the magazine attached firearm grip 104. FIG. 3F illustrates a magazine attached firearm grip having an opening 324 to receive such pin or screw for attachment purposes. Typically, the pin would be inserted through the opening 324 to engage a portion of the magazine. A screw will typically engage a threaded opening formed in the magazine and be secured by turning the screw within such opening. Though shown at the front of the magazine attached firearm grip 104, one or more openings 324 may be at various locations.

Figure 4:
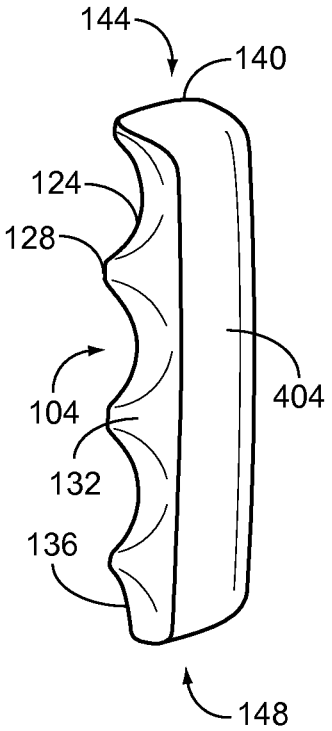
FIG. 4 is a rear perspective view of an exemplary magazine attached firearm grip having a flat rear side.

FIG. 4 illustrates another embodiment of the magazine attached firearm grip 104 where a groove is not present. As can be seen, in this embodiment the back of the magazine attached firearm grip 104 comprises a surface 404. This surface 404 engages and may be attached to a magazine to secure the magazine attached firearm grip 104 thereto.

Figure 1C:
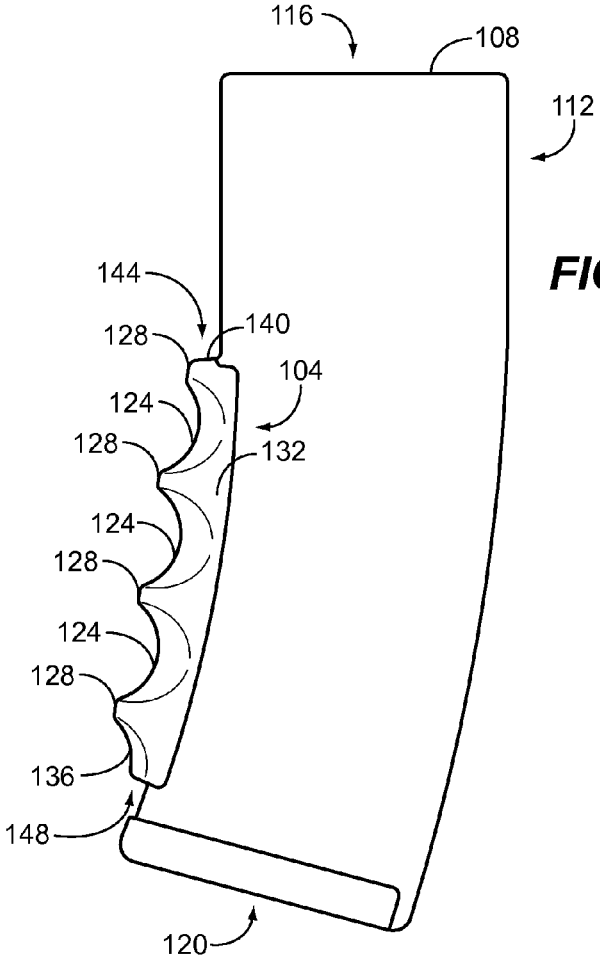
FIG. 1C is a side view of an exemplary magazine attached firearm grip having individual wall sections.
Figure 5:
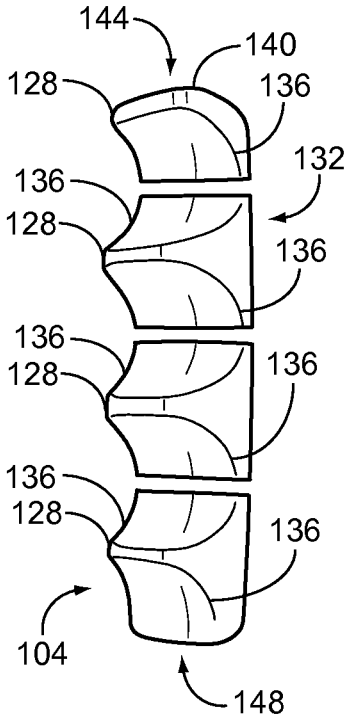
FIG. 5 is a front perspective view of an exemplary magazine attached firearm grip comprising individual wall sections.

FIG. 5 illustrates an embodiment of the magazine attached firearm grip 104 where the magazine attached firearm grip is formed by one or more separate portions, such as discussed briefly above with regard to FIG. 1C. As can be seen, a magazine attached firearm grip 104 may comprise individual wall sections 504 comprising one or more half recesses 136 and a wall 128. The individual wall sections 504 may be attached such as disclosed above. It is noted that the wall sections 504 may be various shapes.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A grip for attaching to a magazine comprising:

a grip body comprising two sides, a top end, a bottom end, a front side, and a rear side, wherein the rear side is an external surface of the grip and the grip body;

a groove formed in the rear side extending from the top end to the bottom end, wherein the groove is dimensioned to receive an edge of the magazine therein; and one or more recesses at the front side, each of the one or more of recesses defined by at least one wall and oriented to extend laterally between the two sides of the grip body;

wherein, when attached to the magazine, the grip and the grip body only engage the magazine at the groove and, when attached to the magazine, the groove is attached to the magazine by an adhesive.

2. The grip of claim 1, wherein the grip body is formed from a flexible material.

3. The grip of claim 1 further comprising a wall at the top or bottom end of the grip body.

4. The grip of claim 1 further comprising a half recess at the top or bottom end of the grip body.

5. The grip of claim 1, wherein the groove is attached to the edge of the magazine by one or more mechanical fasteners.

6. The grip of claim 1, wherein the grip body comprises individual separate wall sections.

7. A magazine with a grip comprising:

a compartment for holding ammunition;

a top portion for insertion into a magazine well of a firearm; and a bottom portion having a grip, the grip comprising:

a grip body at an edge of bottom portion, the grip body comprising a rear side and a front side; and one or more recesses at the front side for receiving one or more fingers, wherein the one or more recesses extend laterally between the two sides of the grip body;

wherein the grip body engages the magazine only at the rear side and is attached to the magazine by an adhesive;

wherein the grip remains attached to the magazine when the top portion of the magazine is inserted into and removed from the magazine well.

8. The magazine with a grip of claim 7 further comprising a half recess at a top end or a bottom end of the grip body.

9. The magazine with a grip of claim 7 further comprising a wall at the top or bottom end of the grip body.

10. The magazine with a grip of claim 7 further comprising a groove at a rear side of the grip body, wherein the bottom portion is received with the groove to attach the grip body to the bottom portion.

11. The magazine with a grip of claim 7, wherein the grip body is formed from a first material and the compartment is formed from a second material.

12. The magazine with a grip of claim 7 further comprising a textured surface on at least the one or more recesses.

13. The magazine with a grip of claim 7 further comprising a textured coating on at least the one or more recesses.

14. A method for forming a magazine with a grip comprising:

providing a grip body comprising one or more recesses extending laterally between two sides of the grip body at a front side of the grip body and a groove at the rear side of the grip body, wherein the one or more recesses are formed between a plurality of outward extending walls;

receiving an edge of a bottom end of a magazine in the groove, wherein the bottom end of the magazine is capped while a top end of the magazine is open; and securing the grip body to the edge of the bottom end of the magazine by applying an adhesive between the groove and the edge of the bottom end of the magazine.

15. The method of claim 14 further comprising forming a half recess at a top or bottom end of the grip body.

16. The method of claim 14 further comprising forming a wall at a top or bottom end of the grip body.

17. The method of claim 14 further comprising flexing the grip body to conform to the edge of the bottom end of the magazine, wherein the grip body is formed from a flexible material.

18. The method of claim 14, wherein securing the grip body comprises engaging one or more mechanical fasteners that extend from the grip body with one or more corresponding openings in the magazine.

* * * * *